United States Patent [19]

Gingold et al.

[11] 4,028,906

[45] June 14, 1977

[54] FOGGING DEVICE FOR COOLING A CONDENSER COIL

[75] Inventors: Albert Gingold, Altamont Springs, Fla.; Charles E. Upchurch, Greenville, S.C.

[73] Assignee: Charles E. Upchurch, Greenville, S.C.

[22] Filed: July 14, 1975

[21] Appl. No.: 595,379

[52] U.S. Cl. ..... 62/183; 62/305; 239/598

[51] Int. Cl.[2] ..... F25B 39/04

[58] Field of Search ..... 62/279, 305, 314, 315, 62/316, 507, 428, 183; 239/597, 598; 165/95

[56] References Cited

UNITED STATES PATENTS

| | | | |
|---|---|---|---|
| 3,613,392 | 10/1971 | DiTucci | 62/305 |
| 3,627,032 | 12/1971 | Glad et al. | 165/95 X |
| 3,872,684 | 3/1975 | Scott | 62/305 |
| 3,877,510 | 4/1975 | Tegtmeier et al. | 239/598 X |

*Primary Examiner*—Ronald C. Capossela
*Attorney, Agent, or Firm*—Bailey, Dority & Flint

[57] ABSTRACT

This invention relates generally to the cooling of a condenser coil in the outdoor compressor unit of a central air conditioning system by injecting an atomized mist of minute water particles into the upstream side of a stream of air passing through the coil for fogging the coil with the mist for more effective and complete evaporation thereof, cooling the coil more efficiently while reducing the amount of residual runoff water.

6 Claims, 7 Drawing Figures

FOGGING DEVICE FOR COOLING A CONDENSER COIL

BACKGROUND OF THE INVENTION

The conventional air conditioning system used for residential dwellings as well as for light industrial purposes utilizes an outside compressor unit having a finned condenser coil which is cooled by passing a stream of outside air through the coil.

The output of such compressor units are rated in British Thermal Units (BTUs) and the ratings are usually given in terms of outside air temperature. For example, a three ton compressor unit rated at (95°) outside air temperature would be rated at 37,000 BTUs and at (80°) outside air temperature the same unit would have a rating of 43,000 BTUs. Thus, it can be seen that if the temperature of the outside air is reduced 15° passing through the compressor unit and across the condenser coil, the capacity of the unit is increased 6,000 BTUs.

Prior devices have been developed for cooling the condenser coil with water for reflecting an overall lower outside air temperature, thus, increasing the efficiency of the compressor unit and lowering the cost of operation. One such device, shown in U.S. Pat. No. 3,613,392, discloses a plurality of outlet nozzles 26 carried on a feeder tube 24 for spraying into water into the space occupied by the condenser coil 12 whenever overload conditions are sensed such as excessive outside or refrigerant temperature. Such an arrangement would provide for more water than would be required for continuous use under normal operating conditions and the dousing of the coil resulting from a plurality of nozzles would tend to waste some of the water which could not be evaporated. According to the number of outlet nozzles 26, such nozzles evidently provide a rather confined stream of spray and do not break up the flow of water into finely divided particles so as to disperse over a large area and so as to be evaporated more completely.

Another prior device, shown in U.S. Pat. No. 3,872,684, discloses an annular fluted ring attachment 24 for the fan which air cools a condensor coil in a window-type air conditioner unit. Water is delivered to a lower pan surface of the air conditioner casing below the fan, and the ring attachment dips into the water to create a spray of water which contacts the finned condenser coil. However, the top of the condenser coil 2 is normally the hottest portions of the coil but the fluted ring 24 arrangement provides the least amounts of spray to this area. In addition, such an arrangement would not be feasible in a system where the fan draws air through the condenser coil, such as in many of the central air conditioning systems, rather than blowing the air through the coil.

SUMMARY OF THE INVENTION

It has been found that an effective device for water cooling an otherwise air-cooled condenser coil of an outdoor compressor unit can be constructed of a single injection nozzle for atomizing a flow of water into a thin mist of finely divided minute water particles. The mist is projected in the form of a fan-shaped curtain in a plane substantially parallel and co-extensive with the condenser coil. The nozzle is carried by a bracket mounted on the compressor unit housing above the condensor coil and above a stream of air passing through the coil. A control valve admits water to the nozzle in response to a compressor motor being energized which delivers refrigerant to the condenser coil. The curtain of mist is received in the stream of air adjacent the coil and prior to passing through the coil for fogging and enveloping substantially the entire coil area.

Thus, by utilizing a mist of very fine minute water particles, more effective and complete evaporation of the water by the coil occurs which cools the coil more efficiently while reducing the amount of residual runoff water.

Accordingly, an important object of the present invention is to provide a device for use with an outdoor compressor unit of a central air conditioning system for cooling the condenser coil of the compressor unit thereby conserving energy and lowering the cost of operation of the air conditioning system.

Still another important object of the present invention is to cool the condenser coil of an outdoor compressor unit with a finely divided mist of minute water particles which fog and adhere to the coil for more effective and complete evaporation of the water particles by the heat from the condenser coil for more efficient cooling of the coil.

Still another important object of the present invention is to fog substantially the entire area of the condenser coil of a compressor unit with a thin mist of finely divided water particles for more complete evaporation of the water particles to reduce the amount of residual runoff water.

Still another important object of the present invention is to provide a simple device for cooling a condenser coil utilizing a thin mist of finely divided water particles which is readily affordable to home owners and can be installed by home owners using easily followed instruction sheets and diagrams.

Another important object of the present invention is to provide a device for cooling a condenser coil of a compressor unit utilizing a thin mist of finely divided water particles which operate automatically when the compressor motor is energized.

Yet another important object of the present invention is to provide an attachment to existing outdoor compressor units which is adaptable to substantially all home air conditioning systems.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate an attachment device for use with a central air conditioning system having an outdoor compressor unit, a housing A for the compressor unit containing a fan B and a compressor motor C, a grilled opening D in the housing A through which a stream of air is created passing through a condenser coil E with associated cooling fins F carried within the housing adjacent the opening D and extending thereover, and the condenser coil E receiving the refrigerant fluid from the compressor motor.

The attachment device comprises a control valve having an inlet port connected to a source of pressurized water and a nozzle means connected to an outlet port of the control valve for receiving a flow of water from the pressurized force when the valve is in open position. A control means is provided for placing the control valve in the open position in response to the compressor motor being energized. The nozzle means has an opening and orifice formed therein for highly atomizing the water into a mist of finely divided water particles, and for projecting a metered amount of the water in the form of the atomized mist as a fan-shaped curtain across an area substantially co-extensive with and adjacent to the housing opening. The curtain of mist is received by the air stream prior to passing through the condenser coil so as to be mixed and further atomised therein for completely fogging and enveloping the condenser coil. Thus, by utilizing a mist of very fine minute particles, more effective and complete evaporation of the water by the condenser coil occurs which cools the coil more efficiently while reducing the amount of residual runoff water.

Figure 1:
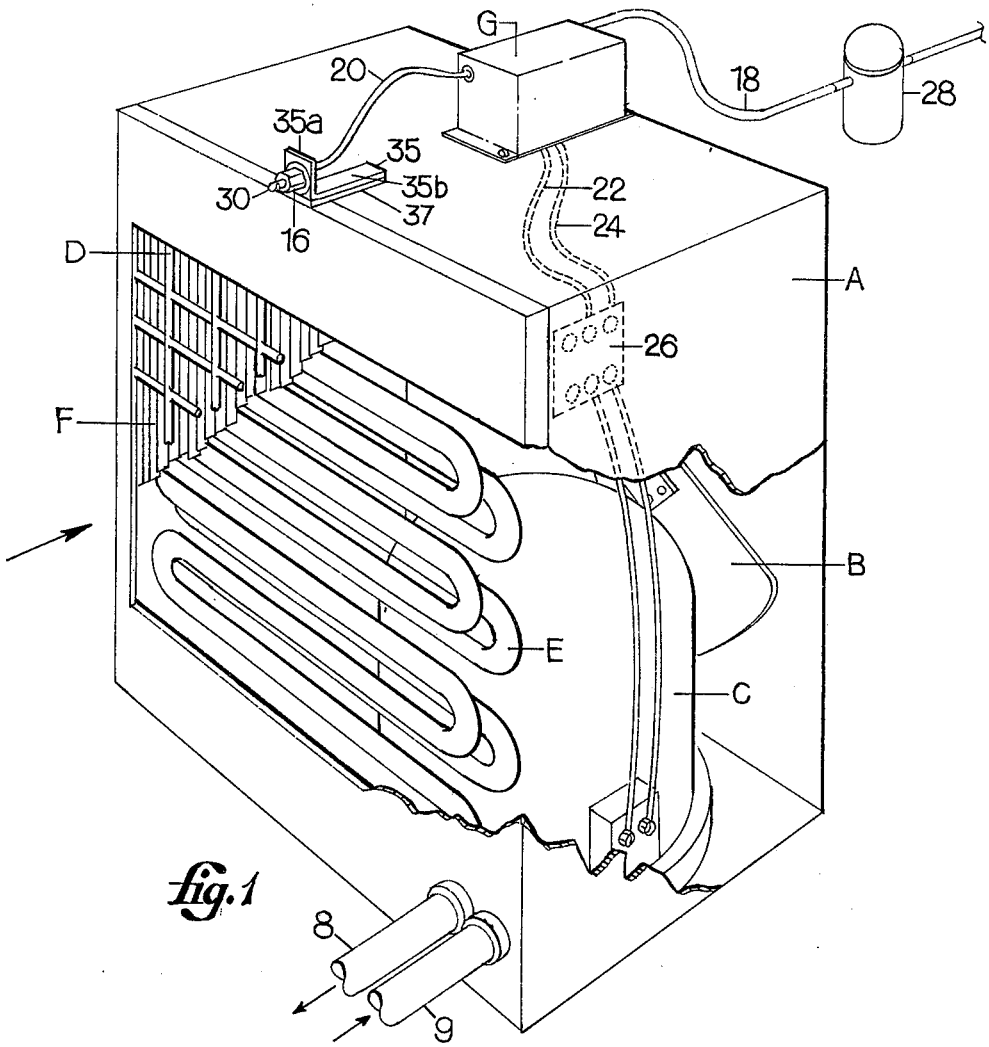
FIG. 1 is a perspective view illustrating a fogging device constructed in accordance with the present invention as an attachment to a compressor unit for cooling a condenser coil with a fine mist of water particles.
Figure 2:
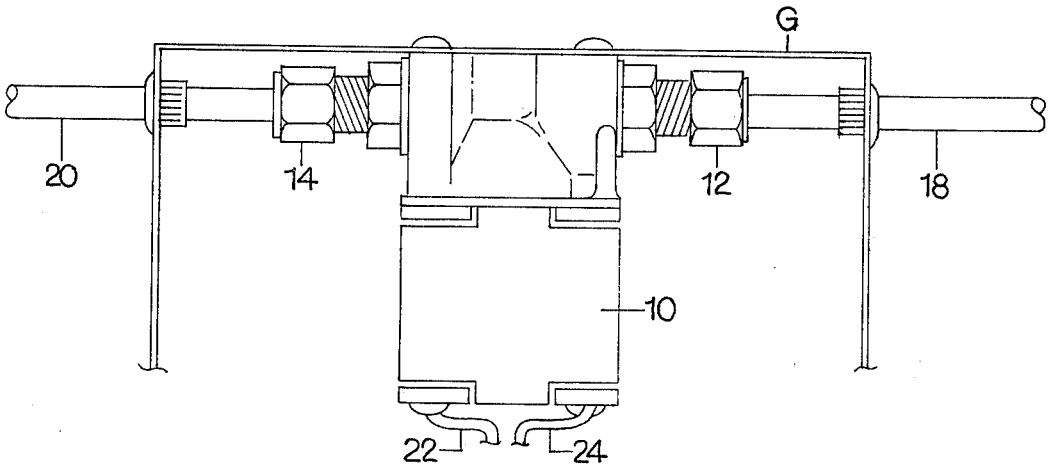
FIG. 2 is a side elevational view of a control valve for admitting a flow of water through a nozzle member constructed in accordance with the present invention with parts of the control box omitted for purposes of clarity.
Figure 3:
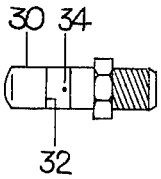
FIG. 3 is a bottom plan view of a nozzle member utilized in the fogging device constructed in accordance with the present invention.
Figure 4:
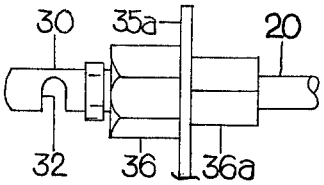
FIG. 4 is a side elevational view of the nozzle of FIG. 3.

Referring now to FIG. 1, an outdoor compressor unit which forms part of a central air conditioning system, such as for residential or light industrial purposes, is illustrated containing a fan B, a compressor motor C, a grilled opening D, and a condenser coil E. The compressor motor C delivers a refrigerant fluid in the form of a liquid through the condenser coil E for cooling the compressed refrigerant. A flow of air is created by the fan B which passes through the opening D and across the coil E to aid in the cooling the compressed refrigerant flowing therethrough.

The remainder of the conventional air conditioning system (not shown) would normally include a cooling or evaporator coil contained in a housing remote from the compressor unit A to which the refrigerant fluid would be delivered from the condenser coil E through a conduit 8. The refrigerant in the form of a liquid is expanded through the cooling coil, such as through an expansion valve, converting the liquid to a gas rapidly cooling the refrigerant and absorbing heat out of air blown over the cooling coil into the interior space of the building which is to be cooled.

The improvement of the present invention includes apparatus for fogging the condenser coil E with a mist of finely divided minute water particles so as to, in effect, lower the temperature of the outside air passing across the condenser coil E and the condenser coil lowering the temperature of the refrigerant flowing therethrough. This results in reduced operating temperatures and head pressure throughout the system resulting in less torque on the compressor motor C in liquifying the refrigerant gas returned from the cooling or evaporator coil through a conduit 9 thereby requiring less electrical current to be drawn by the compressor motor C.

The fogging device of the present invention includes a conventional solenoid control valve 10 having an inlet port 12 connected to a source of pressurized water such as an outside water faucet, and an outlet port 14 which delivers a flow of water to a nozzle means 16 when the solenoid valve 10 is in an open position. The inlet and outlet ports 12 and 14 may be any suitable coupling members for fastening a small diameter conduit 18 and 20 thereto, respectively. The conduits 18 and 20 may be constructed of ¼ inch flexible plastic tubing with conduit 18 being connected to the pressurized source of water, and conduit 20 being connected to the nozzle means. The solenoid valve has a pair of leads 22 and 24 which are preferably connected to a compressor relay 26 so that when the compressor motor C is energized, the solenoid valve will be placed in an open position so as to admit water to the nozzle 16. The control valve 10 is housed within a suitable control box G. The solenoid valve 10 may also be suitably connected in the power line to fan B or in the thermostat line which controls the energization of the compressor unit.

A receptacle 28 containing a suitable solvent or detergent additive is connected in the inlet line 18 for mixing the additive with the water flowing through the solenoid valve 10 and the nozzle means 16 so as to prevent the formation of mineral deposits and other accumulation on the condenser coil E and its associated cooling fins F. The receptacle 28 need not be utilized in all applications of the present invention depending on the source of water and the particular geographical location, and may be of the conventional aspirator type sprayer wherein the flow of water passing through a venturi draws the additive out of the receptacle into the water flow.

The nozzle means 16 includes a single atomizing nozzle 30 having a transverse groove 32 extending across the entire width of the nozzle in a bottom surface thereof, and an orifice 34 is formed in the groove opening. The nozzle structure produces a substantially fan-shaped curtain of mist which will cover substantially the entire surface of a conventional condenser coil for residential or light industrial.

In use, the nozzle 30 is mounted on a bracket means which includes an L-shaped bracket 35 having a leg **35*a* with an aperture formed therein for mounting the nozzle 30 thereto. The nozzle is threadably received in a locking nut member 36 which is fastened to a male coupling member 36*a* and outlet conduit 20 through the aperature formed in leg 35*a*. An elongated 35*b*** joins leg 35*a* of the bracket for attaching the bracket 35 and nozzle 30 to the compressor unit housing A using any suitable fastening means such as a strip of double stick adhesive 37. The bracket and nozzle are preferably mounted on the top of the housing A about six inches above the condenser coil E with the mist injected downwardly into the air flow.

A preferred nozzle 30 is manufactured by Spraying Systems Co., Wheaton, Ill., model 1/8KI which has an orifice 34 diameter of 0.033 inches and a flow rate of 0.20 gallons per minute (gpm) at 40 psi. The nozzle projects a curtain of mist having a spray angle $\alpha$ of approximately 120° to cover substantially the entire width and height of a conventional condenser coil E for residential and light industrial uses. The spray angle $\alpha$ will vary only slightly with water pressure from 109° at 20 psi to 129° at 60 psi.

Figure 6:
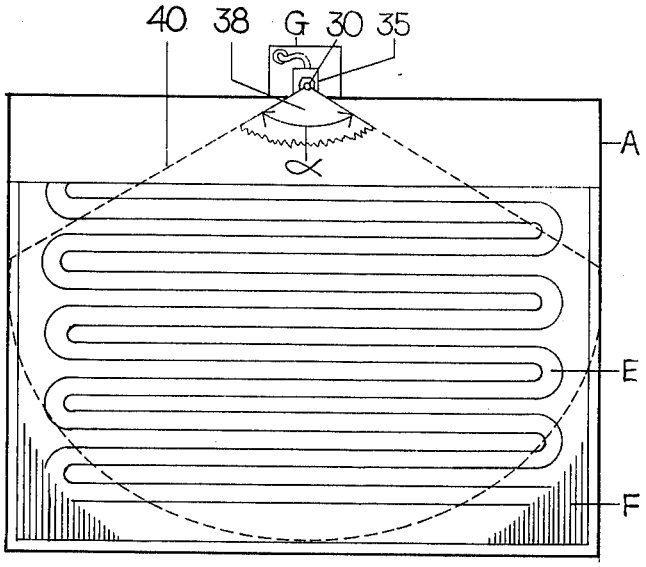
FIG. 6 is a front side elevational view of a compressor unit showing fogging apparatus constructed in accordance with the present invention for fogging the condenser coil with a fine mist of water particles and the curtain of mist produced therefrom.

FIG. 6 illustrates in more detail the curtain of mist provided by the injection nozzle 30 constructed in accordance with the present invention. The conventional residential compressor unit normally has a condenser coil of approximately 2½ feet in width, although a few models extend to approximately 5 feet, and a single nozzle 30 would be sufficient to cover the entire width of the condenser coil. For application to condenser coils much wider than 5 feet, a pair of nozzles 30 may be utilized by using a T-branch connector in output line 20 to provide a pair of lines leading to the nozzles. The fan-shaped curtain of mist produced by the nozzle 30 would include a short curtain of visible mist 38 which would be approximately 1 to 2 inches in length, and the rest of the mist, which covers the condenser coil almost completely as shown in FIG. 6, would be substantially invisible to the eye of an observer, although one could feel the minute particles of the spray and could see that the finned condenser coil was wet. The substantially invisible portion would include that portion within the dotted line 40 shown in FIG. 6.

Figure 7:
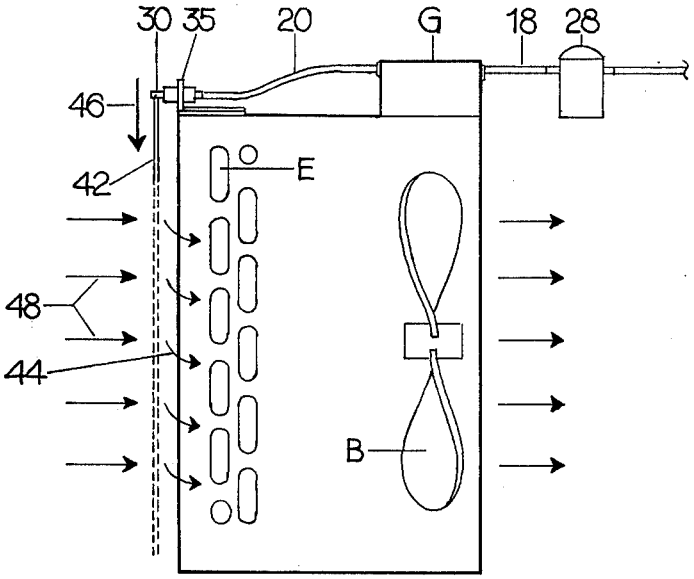
FIG. 7 is a side elevational view of the compressor unit of FIG. 6 illustrating the curtain of mist projected in the fogging device of the present invention.

In the absence of air flow across the coil, the nozzle 30 would project a fan-shaped curtain of mist downwardly in a plane substantially parallel to and co-extensive with the area of the condenser coil E as is illustrated by the dashed line 42 in FIG. 7. However, due to the suction adjacent the condenser coil E when the fan B is on, the curtain of mist projected across the condenser coil by the nozzle 30 will be drawn into the coil as shown at 44 so as to completely fog and envelope the condenser coil. The nozzle 30 injects the curtain of mist in a direction indicated by arrow 46 which is substantially perpendicular to or against the flow of air indicated at 48. When the flow of air strikes the minute particles of water at such an angular orientation, the air flow tends to shear and futher break up the water particles contained in the mist so as to divide the mist into even a more finer and minute particles of water. The resulting mist fogs and envelopes the coil with the fine minute water particles adhering to the tubular members of the coil to be almost completely evaporated by the heat therefrom. By utilizing a mist of finely divided minute water particles, the heat from the condenser coil will more completely and effectively evaporate the water particles so as to more efficiently cool the coil and conserve water by reducing the amount of residual runoff water. In addition, the life of the compressor unit will be extended since its operating time will be reduced according to a more efficient operation.

Large droplets of water or water in the form of a spray stream tends to douse the condenser coil producing incomplete and inefficient evaporation as well as leaving large amounts of residual water. Smaller minute water particles presented with the fogging device of the present invention fog the coil and adhere around the tubular members of the coil so as to be completely evaporated leaving little or no runoff water.

With the nozzle properly mounted above the coil E, the correct amount of water pressure, and the nozzle 30 sized properly for a given condenser coil size, little, if any, of the fine water particles which fog and adhere to the coil E will be unevaporated or carried off by the air stream to the outside.

In one application with a residential dwelling of approximately 1800 sq. feet, a fogging device constructed in accordance with the present invention was utilized with a two and one-half ton central air conditioning system, the electrical power consumed over a given test period decreased by an average 22% as compared to the same home unit without the fogging device. During the test period, the average outside temperature was 90° and the inside temperature was maintained at 78°.

While a preferred embodiment of the nozzle 30 has been disclosed for purposes of illustration, other suitable nozzles may be utilized producing a finer mist and using less water depending on the size of the condenser coil being cooled. For example, a nozzle of the type disclosed having an orifice diameter of 0.016 inches would have a flow rate of 0.05 gpm at 40 psi; and would project a curtain of mist having a spray angle $\alpha$ of approximately 100°. It is also possible that an adjustable nozzle could be utilized so as to adjust the fog to a variety of condenser sizes.

Figure 5:
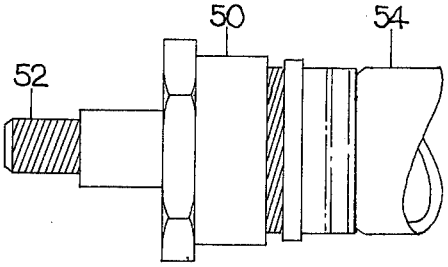
FIG. 5 is a side elevational view illustrating an adapter member for connecting a small diameter plastic hose utilized with the fogging device of the present invention to a standard garden hose coupling.

FIG. 5 illustrates an adapter 50 which can be utilized with the present invention having a barbed end 52 to which the inlet line 18 may be connected so that inlet line 18 may be connected to a standard garden type hose 54 or directly to an outside water faucet.

While a preferred embodiment of the invention has been described using specific terms, such description is for illustrative purposes only, and it is to be understood that changes and variations may be made without departing from the spirit or scope of the following claims.

What is claimed is:

1. A fogging device for cooling a condenser coil in a central air condition system having an outdoor compressor unit, a housing for said compressor unit containing a fan, an opening in said housing through which a stream of air is created flowing across said condenser coil carried within said housing adjacent said opening and extending thereover, said condenser coil receiving refrigerant fluid from a compressor motor, said device comprising:

a control valve having an inlet port connected to a source of pressurized water;

nozzle means connected to an outlet port of said control valve receiving a flow of water from said source when said is in an open position;

means for moving said control valve to said open position in response to said compressor motor being energized; and said nozzle means having an opening and orifice formed therein for highly atomizing said water into a mist of finely divided water particles, said nozzle means projecting a metered amount of water in the form of said atomized mist as a fan-shaped curtain across an area substantially coextensive with and adjacent to said housing opening, said curtain of mist being received by said air stream prior to passing across said coil as to be mixed and further atomized therein for fogging and enveloping said condenser coil with said mist;

whereby said mist of minute water particles adheres more readily to said coil and is more effectively and completely evaporated by the heat from said condenser coil, cooling said coil more efficiently while reducing the amount of residual runoff water.

2. The structure set forth in claim 1 wherein said nozzle means includes a single nozzle positioned by a bracket means for so directing said mist, and wherein said stream of air is drawn by said fan across said coil.

3. The structure set forth in claim 2 wherein said bracket means and nozzle are positioned above said condenser coil and said stream of air on the upstream side of said condenser coil, said bracket means being carried by said housing.

4. The structure set forth in claim 1 wherein said nozzle injects the curtain of mist in a plane substantially parallel to said housing opening and condenser coil and substantially perpendicular to said stream of air flow across said coil to shear and further divide the mist particles prior to fogging and enveloping said condenser coil.

5. The structure set forth in claim 2 wherein said single nozzle includes a transverse groove extending across the width in a bottom surface thereof, and an orifice formed in said groove producing said fan-shaped curtain of mist covering substantially the entire surface of said condenser coil.

6. The structure set forth in claim 1 wherein a receptacle is connected between said source of pressurized water and said inlet port containing an additive which is mixed with said flow of water so as to reduce the formation of mineral deposits and other accumultors on said condenser coil.

* * * * *